United States Patent [19]

Constance-Hughes

[11] Patent Number: 4,696,295

[45] Date of Patent: Sep. 29, 1987

[54] BREATHING APPARATUS

[75] Inventor: Trevor Constance-Hughes, Abergavenny, Wales

[73] Assignee: Siebe Gorman & Company Limited, Berkshire, England

[21] Appl. No.: 837,056

[22] Filed: Mar. 6, 1986

[30] Foreign Application Priority Data

| | | | |
|---|---|---|---|
| Mar. 6, 1985 | [GB] | United Kingdom | 8505787 |
| Apr. 15, 1985 | [GB] | United Kingdom | 8509604 |
| Jan. 27, 1986 | [GB] | United Kingdom | 8601871 |

[51] Int. Cl.[4] ..... A62B 7/00

[52] U.S. Cl. ..... 128/202.26; 128/205.12; 422/177; 422/122; 55/DIG. 33

[58] Field of Search ..... 128/202.26, 201.25, 128/205.27, 205.28, 205.29, 205.12, 205.17; 55/DIG. 33, DIG. 35, 62; 422/122, 181, 177

[56] References Cited

U.S. PATENT DOCUMENTS 4,409,978 10/1983 Bartos ..... 128/202.26

*Primary Examiner*—Henry J. Recla

*Attorney, Agent, or Firm*—Kane, Dalsimer, Kane, Sullivan and Kurucz

[57] ABSTRACT

A self-rescue breathing apparatus has a radial-flow purifier 3 connected between a mouthpiece and a breathing bag 10. An outer plenum of the purifier is open at both ends, a central conduit is open only at the breathing-bag end. Flap valves 50A and 50B control the flow of gas so that exhaled breath passes radially inwards through the purifying medium which gas for inhalation passes freely up the outer plenum, reducing both the resistance to flow and the heating of the inhaled gas that the purifier (which works by exothermic chemical reaction) would otherwise cause.

11 Claims, 9 Drawing Figures

BREATHING APPARATUS

The invention relates to breathing apparatus and components suitable for use in such apparatus, and especially to 'self-rescue' breathing apparatus (and components for such apparatus), that is to say, to breathing apparatus that is worn by, for example, a miner, as part of his normal equipment but is used only in emergencies to enable the wearer to escape through regions that are flooded or are filled with toxic or suffocating gases. Such breathing apparatus does not need to have a very long operating endurance, but must be sufficiently light and, in its usual inoperative condition, compact, that it does not unduly hinder the wearer's work. Such breathing apparatus may include a reducing valve, a demand valve, and a breathing bag.

The invention provides a purifier comprising a volume of permeable purifying material bounded in part by first and second permeable walls, a first inlet in communication with spaces outside both permeable walls, a second inlet in communication with the space outside the first permeable wall but not with the space outside the second permeable wall, and valve means arranged to permit a fluid to flow from one inlet to the other in one direction through the space outside the first permeable wall and to flow in the other direction only through the volume of purifying material.

With a purifier according to the invention in a fluid system in which fluid flows in both directions, the fluid can be caused to pass through the purifying material in the said other direction of flow only, without the need for a separate by-pass duct to carry the fluid flowing in the said one direction, with consequent savings in weight, bulk, and manufacturing cost.

In some circumstances it may be sufficient to provide a single valve that prevents fluid from flowing in the said other direction directly between the second inlet and the space outside the second permeable wall, but it is preferred in general to provide valve means that directly controls the flow in both directions.

One of the said permeable walls may be tubular, the said space "outside" that wall being the interior of the tube, and the other of the said permeable walls may then be tubular and encircle the volume of purifying material. The two tubular permeable walls then advantageously extend between first and second impermeable end walls, the first and second inlets being spaces outside the respective ones of those end walls. The space in the interior of the inner permeable tube then preferably opens out into the first inlet through the first end wall, the space outside the outer permeable tube opens out into the first inlet round the first end wall, and one of those spaces opens out into the second inlet through or round, respectively, the second end wall. The purifier as a whole then readily takes on a compact and convenient cylindrical form, with one inlet at each end.

The outer permeable tube may be the said first permeable wall, so that the flow by-passing the purifying material passes along the outside of the purifier rather than along the centre.

The valve means may comprise non-return valves between the first inlet and the said spaces outside the permeable walls, which are advantageously flap-valves. The valve members of the flap valves are then preferably portions of a continuous sheet of resilient material. When such a valve unit is used with a cylindrical purifier, a peripheral portion of the said sheet of resilient material advantageously forms a valve flap for the outer space and one or more partly cut-out portions of the sheet advantageously form a valve flap or flaps for the inner tube. The partly cut-out portions may be a plurality of sectorial flaps attached to the centre of the sheet and separated by radiating strips that connect the centre to the said peripheral portion of the sheet. The centre of the said sheet of resilient material and an annular portion at the inner edge of the said peripheral portion may be fixed to a support member that has apertures registering with the inner valve flaps.

Such a valve arrangement offers an exceptionally easy and reliable assembly, because only a single fairly large component needs to be manufactured and installed in order to provide the valve members of all the valves in the purifier.

The invention also provides a purifier having a volume of permeable purifying material bounded by first and second impermeable end walls and first and second permeable lateral walls, a space outside the first lateral wall in communication with inlets outside both end walls, a space outside the second lateral wall in communication with the inlet outside the second end wall but not with the inlet outside the first end wall, and valve means arranged to prevent a fluid that is to be purified from passing directly from the said inlet outside the first lateral wall to the said inlet outside the second end wall without passing through the purifying material.

The first permeable lateral wall is advantageously tubular, with the said space "outside" the first lateral wall being the interior of the tube and opening out through apertures in both end walls. The second permeable lateral wall then preferably also tubular, encircling the volume of purifying material.

The purifier may be suitable for removing carbon dioxide from a life-supporting gas mixture.

The invention also provides closed-circuit breathing apparatus comprising a breathing bag, and a purifier according to the invention having one inlet in communication with the breathing bag and the other inlet arranged, when the apparatus is in use, to be in communication with a user.

The valve means is advantageously so arranged that in operation gas flows to the breathing bag through the purifying material and from the breathing bag through the space outside the first permeable wall.

Thus the exhaled gas is heated up by the chemical reactions occurring in the purifier, and then passes to the breathing bag where it can lose heat to the external environment. According to another aspect of the present invention, the breathing bag is advantageously further cooled by the evaporation of liquid from the outside surface of the breathing bag. The cooled gas is then returned to the user to be inhaled without having to pass again through the hot purifying material, and thus reaches the user still somewhat cool, without there having to be provided a separate pipe by-passing the breathing bag for the returning gas, which would be undesirable in the small, light, compact breathing apparatus with which the invention is primarily concerned.

With a cylindrical purifier, the gas advantageously flows from the breathing bag outside the outer permeable wall, which tends to be appreciably cooler than the centre of the purifier.

The apparatus may include a demand valve comprising an inlet, a valve member, an elongate resilient member supported at one end portion and carrying the valve member at a central portion opposite the inlet, and pressure-responsive means arranged to deflect the other end portion of the resilient member in a direction to move the valve member to open and/or close the inlet.

The elongate resilient member acts both as a spring biasing the valve and as a lever connecting the valve member and the pressure-responsive means.

The resilient member may be so arranged that in operation it holds the valve member in a position closing the inlet and the pressure-responsive means may then be arranged to deflect the resilient member to permit the valve to open.

The pressure-responsive means may comprise a diaphragm exposed on one side to the pressure downstream of the inlet and on the other side to a reference pressure, which is advantageously ambient pressure, and a lever arranged to be rotated by the diaphragm as the diaphragm moves and to deflect the resilient member as it rotates. The demand valve will then open only when the pressure downstream of the inlet is far enough below ambient pressure that the pressure difference across the diaphragm can overcome the resilient member. Preferably, however, the resilient member is set so that it only just maintains the valve closed against the maximum operating pressure in the inlet, so that the valve will begin to open at a low pressure difference across the diaphragm.

The elongate resilient member may be supported by clamping means at an extreme end portion and by a fulcrum member, which may be in the form of a cross-bar supported on posts on either side of the resilient member, between the clamping means and the inlet and on the opposite side of the resilient member from the inlet, and when the valve member closes the inlet the resilient member preferably engages the clamping means, the valve member, and the fulcrum member and is stressed thereby to exert pressure on the fulcrum member and the valve member. A substantial force can then be applied to the valve member without the clamping means being subjected to a large torque, because a couple can be produced by normal forces at the clamping means and the fulcrum member together.

The invention also provides a demand valve comprising an outlet from a gas-supply duct into the interior of the valve having a valve seat, a valve member arranged to close the outlet, and a valve lever supporting the valve member, wherein the valve member has a spherically convex rear face that engages a corresponding formation on the valve lever and is adjusted by rotation to a preferred orientation for engaging the valve seat.

Usually, the valve seat and the portion of the valve member that engages it will each be planar, and if they are not parallel when they come into contact then an unacceptably large actuating pressure may be necessary to effect a seal. Especially when, as is preferred, the valve lever is the elongate resilient member mentioned above, the possibility of adjusting the orientation of the valve member after the resilient member has been set to a desired stress greatly facilitates achieving reliable closing of the inlet with low actuating forces.

The said corresponding formation on the valve lever is advantageously the rim of a circular aperture in the valve lever.

The valve member is preferably adhesively secured or otherwise bonded in the said preferred orientation relative to the valve lever once that orientation is found while assembling and adjusting the valve. The valve member may be secured to the valve lever by causing or permitting a silicone sealant compound to set around them.

The invention further provides a pressure-reducing valve comprising a cylinder having a closed end, a piston slidably movable within the cylinder and in sealing engagement with the walls of the cylinder, an inlet for gas under pressure into the cylinder between the piston and the closed end, and a valve member attached to the piston, the arrangement being such that the pressure of the gas or other fluid within the cylinder acting on the piston tends to urge the valve member in a direction to decrease the degree of opening of the inlet, and means resiliently biasing the piston in a direction to increase the degree of opening of the inlet.

The opening of the inlet is thus governed by the gauge pressure in the cylinder (measured relative to the pressure on the outside of the piston). The resiliently-biasing means determines the pressure-response obtained. Because of the location of the inlet, only one fluid-tight sliding seal is needed, around the piston, instead of the two that are necessary in conventional piston-actuated pressure-reducing valves, with a consequent reduction in maintenance and increase in reliability.

Advantageously, a hollow post, the interior of which conveys the gas under pressure, extends across the cylinder between the piston and the closed end, the inlet is a port in the wall of the post opening towards the closed end of the cylinder, and the valve member is connected to the piston by tie-rods straddling the post. The means resiliently biasing the piston is advantageously a compression spring acting on the outside of the piston.

The invention also provides a pressure-reducing valve comprising a housing, a member movable within the housing, which member preferably is, or is operatively connected to, the piston or the valve member mentioned above, to open and close the valve and having a portion that projects outside the housing by an amount that depends on the degree of opening of the valve, and means engaging the projecting portion and arranged to hold the valve closed.

The projecting portion advantageously projects more when the valve is closed than when the valve is open, and the holding means then preferably comprises a lever having a first end portion engaging under a head on the projecting portion, a central portion engaging the housing as a fulcrum, and a second end portion, and so arranged that the second end portion can be urged towards the valve housing to hold the valve closed.

The projecting portion of the movable member may be an extension of the piston out of the end of the cylinder opposite the said closed end.

When, as is preferred, the pressure-reducing valve is arranged for use as a cylinder-outlet valve, the holding means can be used to hold the valve closed when it is not in use and can be arranged to release the valve automatically when apparatus to which the valve is connected is brought into operation, thus avoiding the need for the maker to provide and the user to operate a conventional cylinder-outlet shut-off valve. The pressure-reducing valve may be arranged for use as the cylinder-outlet valve of an oxygen cylinder in closed-circuit breathing apparatus.

The invention further provides breathing apparatus comprising a pressure-reducing valve according to the invention.

Advantageously, the pressure-reducing valve comprises means as mentioned above arranged to hold the valve closed, and the breathing apparatus comprises a cover that is removed when the apparatus is brought into operation and that is arranged so to engage the holding means that the pressure-reducing valve is held closed while the cover member is in place.

The invention also provides a breathing bag for closed-circuit breathing apparatus, folded and rolled substantially as hereinafter described with reference to FIG. 6 of the accompanying drawings, which gives a roll that is extremely compact, having regard to the size of the bag and the properties of the materials from which such bags are made, and that readily opens out for use.

The invention further provides breathing apparatus which includes a breathing bag according to the invention.

The breathing bag, in the usual orientation of the apparatus, is preferably enclosed within a bottom cover member that is removed when the apparatus is brought into operation, and so constructed and arranged as to tend to fall and open out under its own weight to hang from the apparatus when the bottom cover member is removed. With a breathing bag folded and rolled according to the invention, that can readily be achieved provided that the breathing bag can fall free, and the opening out of the bag is completed when the user of the apparatus first exhales into the apparatus.

The invention also provides breathing apparatus comprising a unit with top and bottom cover members covering parts of the apparatus that are to be extended when the apparatus is brought into operation to occupy space outside the positions of the cover members, and members in tension extending from one cover member to the other, the cover members being so arranged that they are secured to the apparatus by virtue of being secured to each other by the members in tension, and at least one said member in tension being breakable or otherwise readily removable by a wearer of the apparatus to enable the cover members to be removed speedily.

The said at least one member in tension is advantageously a wire, and at least one other said member in tension is advantageously a mono-filament fibre. The cover members are then preferably so arranged that when the wire is broken the tensile energy in the mono-filament will tend to assist in dislodging the cover members from the apparatus. The top cover member may cover a facemask, mouthpiece, or the like and a flexible hose connecting it to the rest of the apparatus, and the bottom cover member may cover a breathing bag if the apparatus is closed-circuit breathing apparatus.

The invention further provides a breathing bag for closed circuit breathing apparatus, comprising an inner layer of impervious material and an outer layer of liquid-absorbent material.

The outer layer may be of fibrous material, and is advantageously of a mixture of cotton and polyester fibres. Such a fibrous outer layer provides resistance to tearing and abrasion of the breathing bag caused by contact with external objects, and reduces the risk that the impervious inner layer will be ruptured in use.

The invention also provides breathing apparatus that includes a breathing bag according to the invention.

Advantageously, the breathing apparatus is for emergency use, the outer layer of the breathing bag is soaked with liquid, and the breathing bag is stored in a sealed compartment of the apparatus, and is arranged to be exposed to the exterior when the apparatus is brought into operation. The liquid will then tend to evaporate, cooling the breathing bag and thus the gas in the breathing circuit within it. Such evaporative cooling will last only for a short period, until the liquid is completely evaporated, unless the cooling liquid is replenished, but the cooling pattern can be made to correspond to the typical operating cycle of a self-rescue breathing apparatus. The said liquid is preferably aqueous, because the high specific latent heat of evaporation of water makes it possible to obtain a large total cooling action from a necessarily limited volume of liquid. The liquid may include an additive, or a combination of additives, that is a bacteriostatic agent, and/or is a wetting agent, and/or reduces the freezing point of the liquid, and/or reduces the boiling point of the liquid. It has been found that a single additive will produce all four of those effects, at the expense of some loss of latent heat capacity.

The invention further provides breathing apparatus arranged to be worn on the chest of a user and provided with two loops of elasticated material arranged to pass behind the shoulders of the wearer to hold the apparatus in position. The apparatus may then comprise a waist belt arranged to be worn by the user and having thereon a pouch within which the apparatus is stored when not in use.

The invention also provides breathing apparatus comprising a waist-belt, a diagonal shoulder-belt attached thereto, and a unit slidably mounted on the diagonal belt holding the operative parts of the breathing apparatus and arranged to be worn at approximately waist-level on a bottom end portion of the diagonal belt when not in use and to be slid up onto the wearer's chest when it is brought into operation.

If, as is preferred, the breathing apparatus incorporates some or all of the other aspects of the present invention mentioned above, then it is possible to construct a self-rescue breathing apparatus that is small enough to hang at the waist without seriously inconveniencing the wearer while still giving satisfactory performance when it is needed.

Various forms of breathing apparatus constructed in accordance with the invention will now be described by way of example only with reference to the accompanying drawings, in which.

Figure 1:
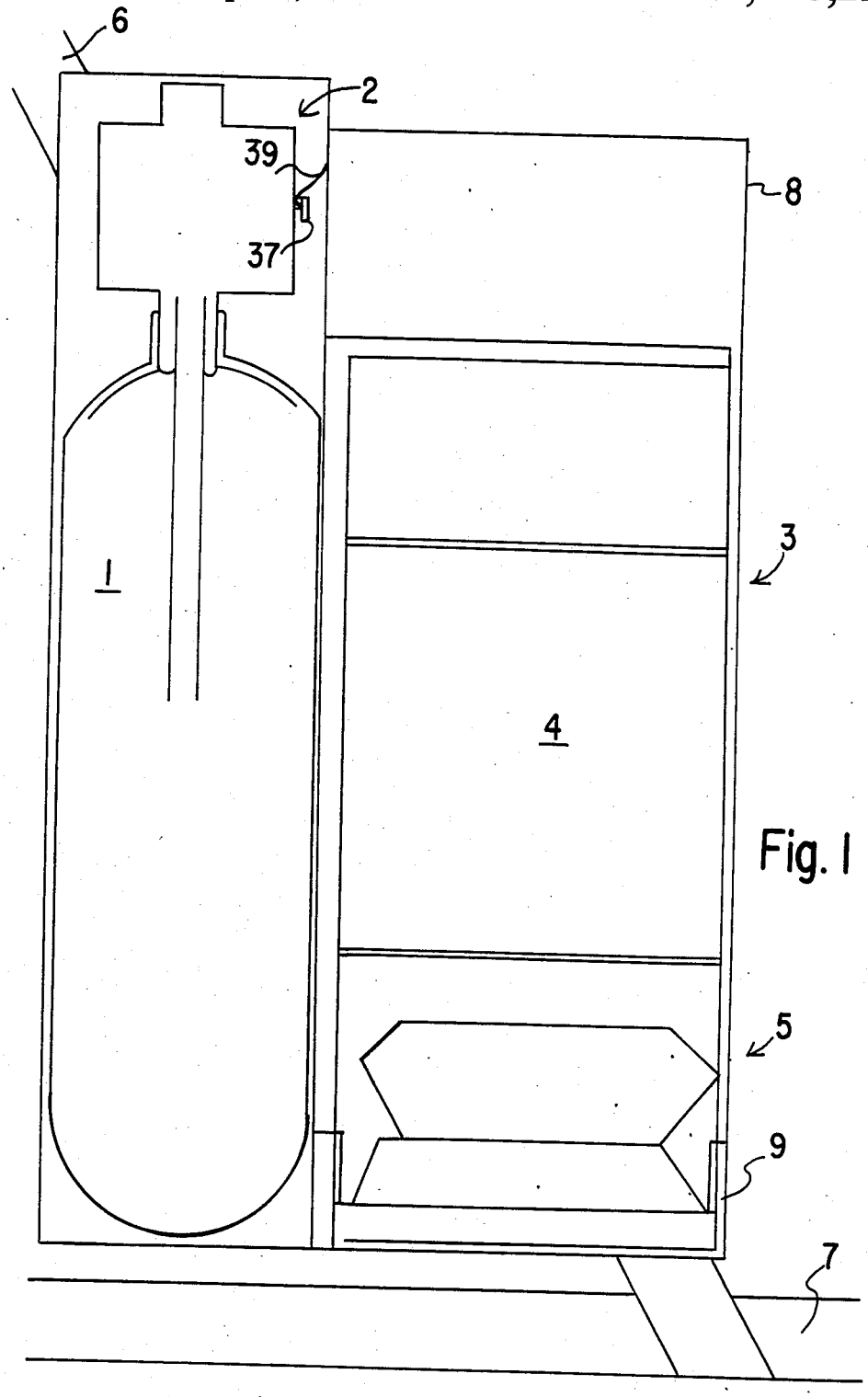
FIG. 1 is a schematic view of one form of self-rescue breathing apparatus in an inoperative, ready-for-use, condition.

Referring to the accompanying drawings, one form of closed-circuit breathing apparatus suitable for use as a self-rescue apparatus comprises an oxygen cylinder 1 with a cylinder-head valve assembly indicated generally by the reference numeral 2, a purifier indicated generally by the reference numeral 3 containing a granular material 4 that can remove carbon dioxide chemically from air, and a demand valve indicated generally by the reference numeral 5 that in operation releases, into the gas being breathed by a user of the apparatus, oxygen supplied to it from the oxygen cylinder 1 by the cylinder-head valve 2.

As may be seen from FIG. 1, the oxygen cylinder 1 with the cylinder-head valve 2 on top of it, and the purifier 3 with the demand valve 5 under it, form two generally cylindrical modules secured side-by-side and in use carried by a wearer by means of a harness that comprises a diagonal shoulder-belt 6, to which the self-rescuer is slidably attached, and a waist-belt 7.

In the inoperative configuration shown in FIG. 1, a top cap 8 is secured on top of the purifier 3, and a nose-clip and mouthpiece, with a flexible hose connecting the mouthpiece to the purifier, are stored under the top cap. The nose-clip, mouthpiece, and hose may be of conventional design, and in the interests of clarity have been omitted from FIG. 1.

Similarly, a bottom cap 9 is secured under the demand valve 5 and contains within it a breathing bag 10 which in the interests of clarity has been omitted from FIG. 1. The top cap 8 and the bottom cap 9 are connected together by a wire (not shown) on one side of the purifier 3 and a monofilament fibre (not shown) on the other side of the purifier. Both the wire and the nylon strand are in tension, and serve to hold the top and bottom caps 8 and 9 in position seated on the purifier module. The rims of the caps 8 and 9, and the surfaces of the module which they abut, may be configured to provide reliable seating of the caps under the tension in the wire and the fibre. The wire is sufficiently thin to be easily broken by a wearer of the self-rescuer, and the caps 8 and 9 are so arranged that if the wire is broken they readily become detached from the rest of the apparatus, assisted by the tension in the monofilament fibre. A handle may be provided to assist the wearer in breaking the wire.

Figure 2:
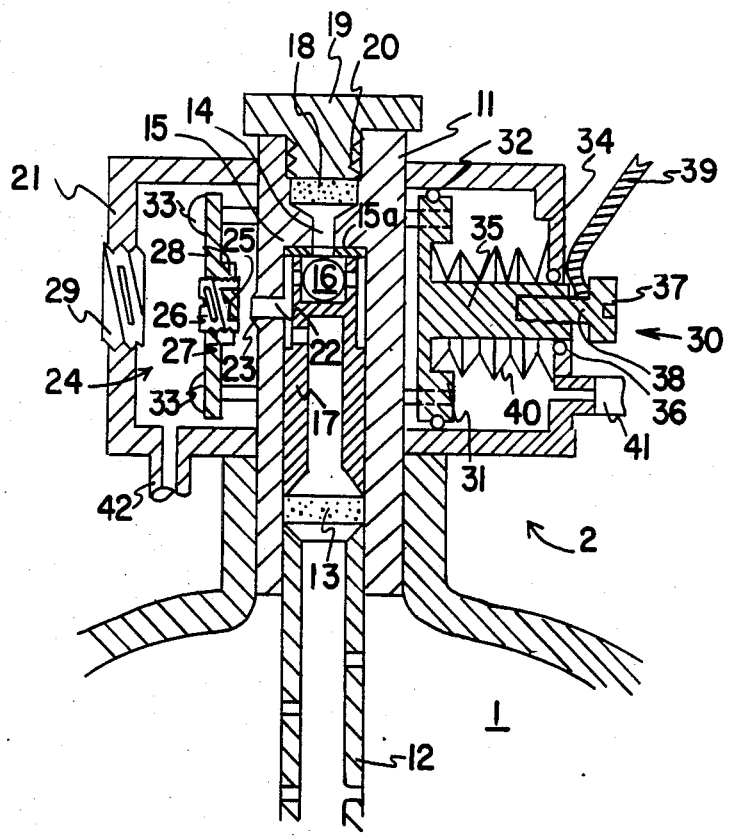
FIG. 2 is a cross-sectional view of a cylinder-head reducing valve, to a larger scale than FIG. 1.

Referring now to FIG. 2, the cylinder-head valve 2 comprises a hollow cylindrical post 11 a lower end portion of which is secured within and sealed to the mouth of the oxygen cylinder 1 by appropriate means which may be conventional and typically include a screw-threaded connection. Within the lower end portion of the post 11 is an upper end portion of an anti-rust tube 12. The anti-rust tube 12 is a perforated tube that extends down into the oxygen cylinder 1 and permits oxygen from the cylinder to enter the post 11 while sieving out flakes of rust and other coarse debris that may be present in the cylinder.

The upper end of the anti-rust tube 12 is closed off by a porous sintered copper disc 13 that filters out finer debris. In an upper portion of the high-pressure tube 11 there is a constriction 14 defined by an annular flange 15 the underside of which is provided with a valve seat 15*a*. Below the flange 15 is a spherical ball 16, smaller than the unconstricted internal diameter of the high-pressure tube 11 but larger than the diameter at the constriction 14 and held in proximity to the valve seat 15*a* by a support 17. Above the constriction 14 is another porous sintered copper filter 18, and above that the top end of the high-pressure post 11 is closed off by a screw-plug 19 sealed by an O-ring 20.

The post 11 passes diametrally across a horizontal cylinder 21 the internal diameter of which is about twice the external diameter of the high-pressure tube. The walls of the cylinder 21 are welded or otherwise joined and sealed to the high-pressure post 11 to give structural strength and to ensure that the cylinder does not leak around the tube. A port 22 opens out through the wall of the post 11 along the axis of the cylinder 21, to the left as shown in FIG. 2. The outer end of the port 22 is surrounded by a raised rim 23 forming a valve seat. The left-hand end of the cylinder 21 is closed.

The valve seat 23 is faced by a valve member indicated generally by the reference numeral 24, which comprises a resilient pad 25 in a holder 26 carried by a support plate 27. The support plate 27 is in a plane perpendicular to the axis of the cylinder 21 and spans most of the diameter of the cylinder, but is not sealed to the walls of the cylinder, and may be apertured to ensure a free flow of gas from one side of the plate to the other. The holder 26 is a member screwed into a threaded hole in a bush 28 in the centre of the support plate 27 and holding the resilient pad 25 in a recess in its right-hand (as seen in FIG. 2) end. The axial position of the resilient pad 25 relative to the support plate 27 can be adjusted by screwing the holder 26 in or out, and the back end of the holder 26 is provided with a slot for a screw-driver. An aperture with a screw-plug 29 or other removable closure may be provided in the closed end of the cylinder 21 in order that the holder 26 may be adjusted after the valve 2 has been assembled.

Instead, the resilient pad 25 may be fixed to the support plate 27, the aperture with the screw-plug 29 may be omitted, and any necessary adjustment may then be made by inserting shims under a spring 40 that biases the valve.

On the other side of the high-pressure post 11 (the right-hand side as seen in FIG. 2) there is a piston indicated generally by the reference numeral 30 in the cylinder 21. The piston 30 comprises a piston-head 31 that is sealed to the walls of the cylinder 21 by an O-ring 32. The piston-head 31 is rigidly connected to the support plate 27 by at least two tie-rods 33 (four as shown in FIG. 2) straddling the post 11.

The right-hand end of the cylinder 21 is closed by an end-plate 34 with a central aperture through which passes a piston-rod 35 of the piston 30. The piston rod 35 is sealed to the end-plate 34 by an 0-ring 36. The end portion of the piston rod 35 outside the end-plate 34 has an annular groove defining a head 37 connected to the main part of the piston rod by a neck 38. The head 37 and neck 38 may be formed by a screw that is screwed partly into a threaded bore in the piston rod 35. A forked end portion of a lever 39 engages the head 37 on either side of the neck 38. A curved portion of the lever 39 engages the end plate 34 as a fulcrum, beyond which the lever extends upwards and to the right as shown in FIG. 2. As is shown in FIG. 1, the lever 39 is so positioned that when the top cap 8 is in place a side face of the top cap holds the upper arm of the lever to the left. That causes the lower, forked, end portion of the lever to hold the head 37 of the piston rod 35 to the right and, through the piston rod, the piston head 31, and the tie-rods 33, holds the valve member 24 to the right. The holder 26 and/or the screw 37 and 38 is/are so adjusted in the support plate 27 that with the top cap 8 in place the resilient pad 25 of the valve member 24 is pressed against the valve seating 23 and completely seals off the port 22.

A stack of frusto-conical washers 40 forms a compression spring acting between the piston head 31 and the end plate 34 of the cylinder 21.

A relief valve 41 (not shown in detail) permits any excess of pressure in the region between the piston head 31 and the end plate 34 to escape to the exterior.

An oxygen pipe 42 communicates with the region between the piston head 31 and the closed (left-hand) end of the cylinder 21.

Figure 3:
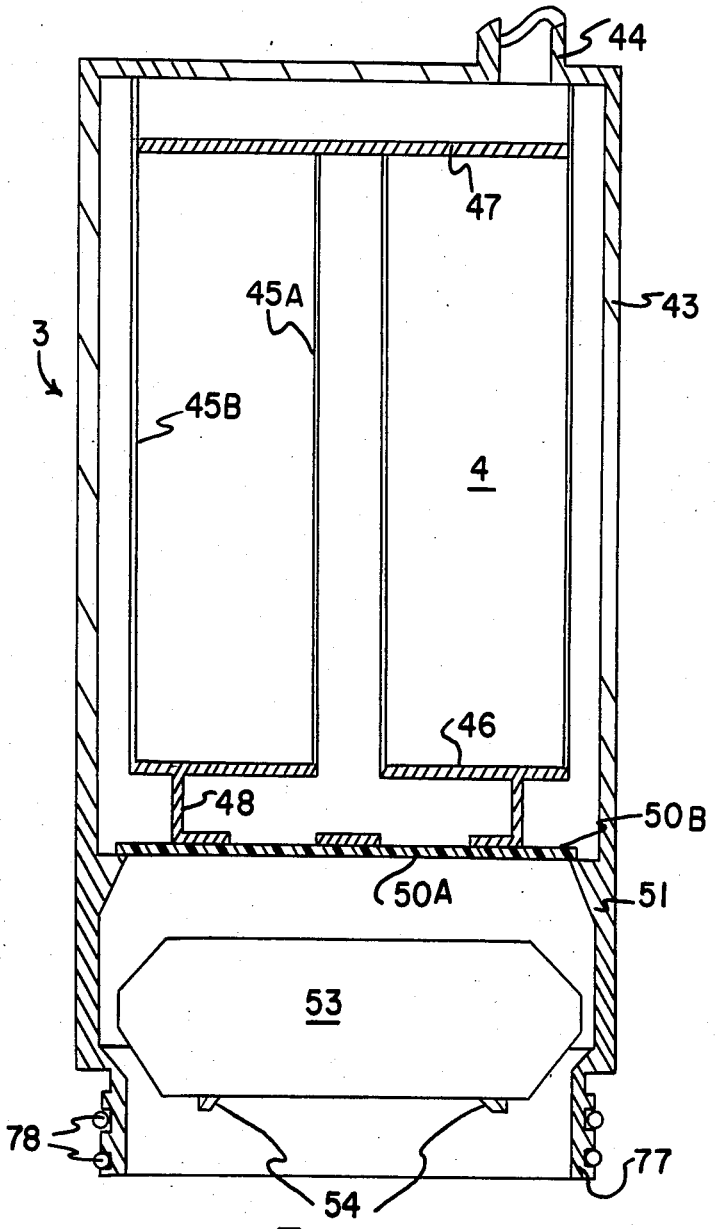
FIG. 3 is a cross-sectional view of a purifier and demand valve assembly, to a larger scale than FIG. 1.

Referring now to FIG. 3 of the drawings, the purifier 3 comprises a cylindrical housing 43 closed at the top, with a connector 44 for the hose connected to the mouthpiece opening through the top wall. The purifier 3 has two right circular cylindrical perforated tubes 45A and 45B which are coaxial with each other and with the cylindrical housing 43. A solid end plate 46 closes off the space between the perforated tubes 45A and 45B at their bottom ends, and a solid end plate 47 closes off both the space between the perforated tubes 45A and 45B and the space inside the inner perforated tube 45A at the upper ends of the tubes. The plenum outside the outer perforated tube 45B thus opens out round both the bottom end plate 46 and the top end plate 47, while the interior of the inner perforated tube 45A opens out only through the bottom end plate 46. The outer perforated tube 45B extends past the top end plate 47 to the top of the housing 43, forming an additional filtering screen between the connector 44 and the rest of the purifier 3. A housing 48 is attached to the underside of the lower end plate 46, enclosing the open bottom end of the inner perforated tube 45B and defining with the bottom end plate a valve box. An aperture 49 in the valve box housing 48 is covered on its under side by valve flaps 50A. The lower end of the outer plenum is closed by a valve flap 50B resting on a seating 51. The valve flap 50A may be resilient and sufficiently pre-stressed to remain closed against the force of gravity when there is no pressure difference across it. The annular space bounded by the outer and inner perforated tubes 45A and 45B and lower and upper end plates 46 and 47 is filled with the carbon dioxide absorbing material 4. The bottom end plate 46 may be supported by, for example, a spider (not shown).

Figure 4:
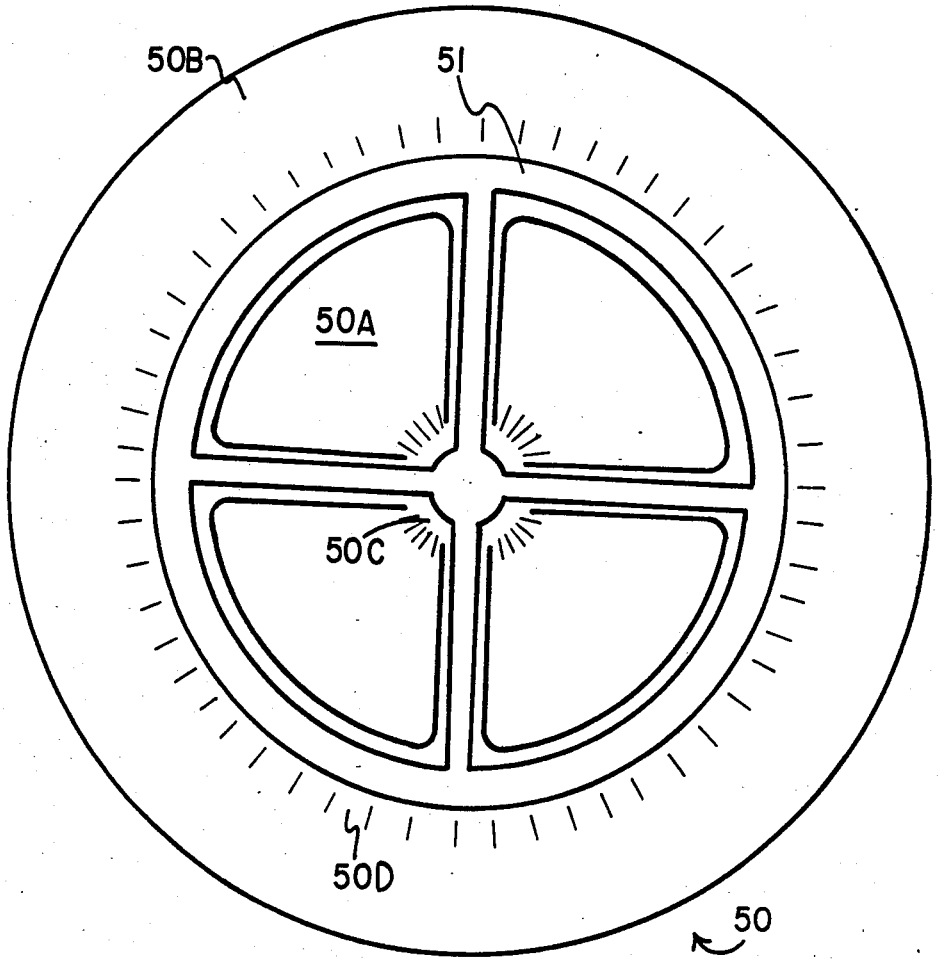
FIG. 4 is a plan view of a valve component in the assembly shown in FIG. 3, to a larger scale than FIG. 3.

Referring now to FIG. 4, the valve flaps 50A and 50B are parts of a single disc of elastomeric or other suitable material indicated generally by the reference numeral 50. An outer peripheral portion of the disc forms the outer valve flap 50B. The inner valve flaps 50A are sectors of the disc cut out along an arcuate outer edge and two approximately radial side edges, and attached at their apices near the centre 50C of the disc. An annular region 50D between the inner and outer valve flaps 50A and 50B, and the centre 50C, may be secured by adhesive bonding or otherwise to a support 51 or may be secured directly to the valve box 48. As may be seen from FIG. 4, the centre 50C and the annular region 50D of the valve disc 50 are connected by radial strips between the inner valve flaps 50A, and the support 51 follows the shape of the centre, the annular region, and the radial strips of the valve disc.

The demand valve 5 comprises a capsule 53 that is supported on four radially spaced-apart brackets 54 within a bottom end portion of the housing 43, the regions above and below it being in communication between the brackets.

Figure 5:
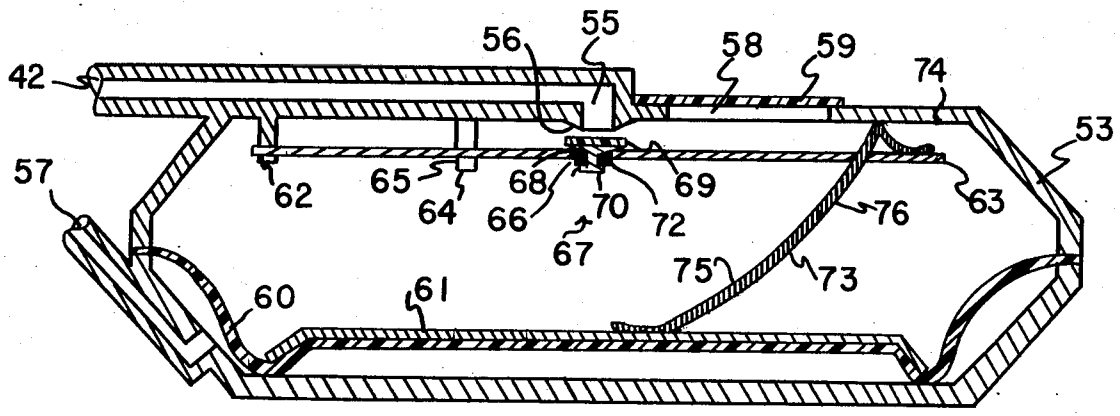
FIG. 5 is a cross-sectional view of a demand valve capsule, to a larger scale than FIG. 3.

Referring now to FIG. 5, the oxygen pipe 42 passes through the housing 43 and is in communication with the interior of the demand-valve capsule 53 through a port 55 in the centre of the top of the capsule. The port 55 is surrounded by a raised rim 56 that forms a valve seat. A pipe 57 that is in communication with the ambient atmosphere at one end passes through the housing 43 and opens out into the demand-valve capsule 53 through a lower wall. The interior of the capsule 53 is in communication through a large opening 58 in its top with the region within the housing 43 below the valve disc 50. The large opening 58 in the top of the capsule 53 is covered by a flap valve 59 that prevents any particles that may fall from the purifier material 4 from entering the valve capsule 53.

Within the demand-valve capsule 53 is a flexible diaphragm 60 with a central stiffening plate 61. The diaphragm 60 is secured to the walls of the capsule 53 round the sides thereof above the level of the opening from the ambient atmosphere inlet pipe 57, and is so arranged that it can lie substantially limp against the walls of the lower part of the capsule.

A post 62 projects downwardly from the top wall of the demand-valve capsule 53 near the periphery thereof. To the post 62 is secured a lever-blade 63 of resilient material that extends generally horizontally across the middle of the top wall of the capsule, and across the oxygen port 55. Between the oxygen port 55 and the post 62 are a pair of further posts 64, one on each side of the blade 63, between which a crossbar 65 extends under the blade. The crossbar 65 is of inverse U or V shaped cross-section, with the blade 63 resting on its central convexity. The height of the post 62, or of the further posts 64, or both, may be adjustable to adjust the stress in the blade 63. Between the cross-bar 65 and its free end, the blade 63 is curved, as seen in transverse cross-section, with its convex side towards the oxygen port 55. The curvature stiffens that part of the blade 63, and the curved surface acts as a deflector for the gas flowing from the oxygen port 55. Opposite the oxygen port 55 is a circular hole 66 in the blade 63, on the rim of which rests a valve member indicated generally by the reference numeral 67. The valve member 67 comprises a body 68 in the form of a minor segment of a sphere, the upper, flat, face of which is covered by a resilient pad 69 and the lower, convex, face of which rests on the rim of the hole 66. From the centre of the convex face of the body 68 projects a short stalk 70 on the end of which is a flat head 71 that is of slightly smaller diameter than the hole 66. When the demand valve 5 is assembled, the blade 63 and the valve member 67 are adjusted so that the resilient pad 69 seats flat against the valve seat 56 and the blade 63 exerts just sufficient force on the valve member to keep the valve closed against gravity and against the operating pressure in the oxygen tube 42. A silicone material 72 is then introduced between the head 71 of the valve member 67 and the blade 63 and allowed to set. Because of the convexity of the lower face of the body 68, the valve member is to some extent self-aligning, which facilitates the initial adjustment of the valve, but the silicone material 72 removes the risk that the valve member will become displaced in operation and the valve will fail to function correctly.

An asymmetrical V-shaped lever 73 rests with its angle against the underside of the top wall of the demand valve capsule 53 as a fulcrum, with a short arm 74 engaging the free end of the blade 63, and with a long arm 75 engaging the stiffening plate 61 of the diaphragm 60. The lever 73 may be held in place, if necessary, by any appropriate means. Because the lever 73 and the blade 63 lie, and must in operation move, in the same plane, the blade is broader than the long arm 75 of the lever and has near the fulcrum an aperture 76 through which the lever passes. As may be seen from FIG. 4, if the diaphragm 60 rises it rotates the lever 73 in such a sense (clockwise as seen in FIG. 4) that the short arm 74 of the lever urges the free end of the blade 63 downwards, lowering the valve member 67 away from the oxygen port 55 and opening the valve. Because the blade 63 effectively pivots about the crossbar 65, instead of about the post 62, a comparatively large movement of the free end of the blade is needed to operate the valve, and that is provided by the shape of the lever 73 and by the length of travel of the centre of the diaphragm 60.

The bottom half of the demand valve capsule 53 may be made removable to afford access to the demand valve mechanism.

Referring again to FIG. 3, the extreme bottom end portion of the housing 43, below the demand valve 5, is formed as a connector 77, with 0-rings 78 or other appropriate sealing means, for the mouth of the breathing bag 10. Because the breathing bag 10 and the demand valve 5, which are the two parts of the apparatus most sensitive to the ambient pressure, are so close together, the effect of a difference in pressure between them, which could be appreciable under water and would depend on the wearer's attitude, is minimized.

Figure 6:
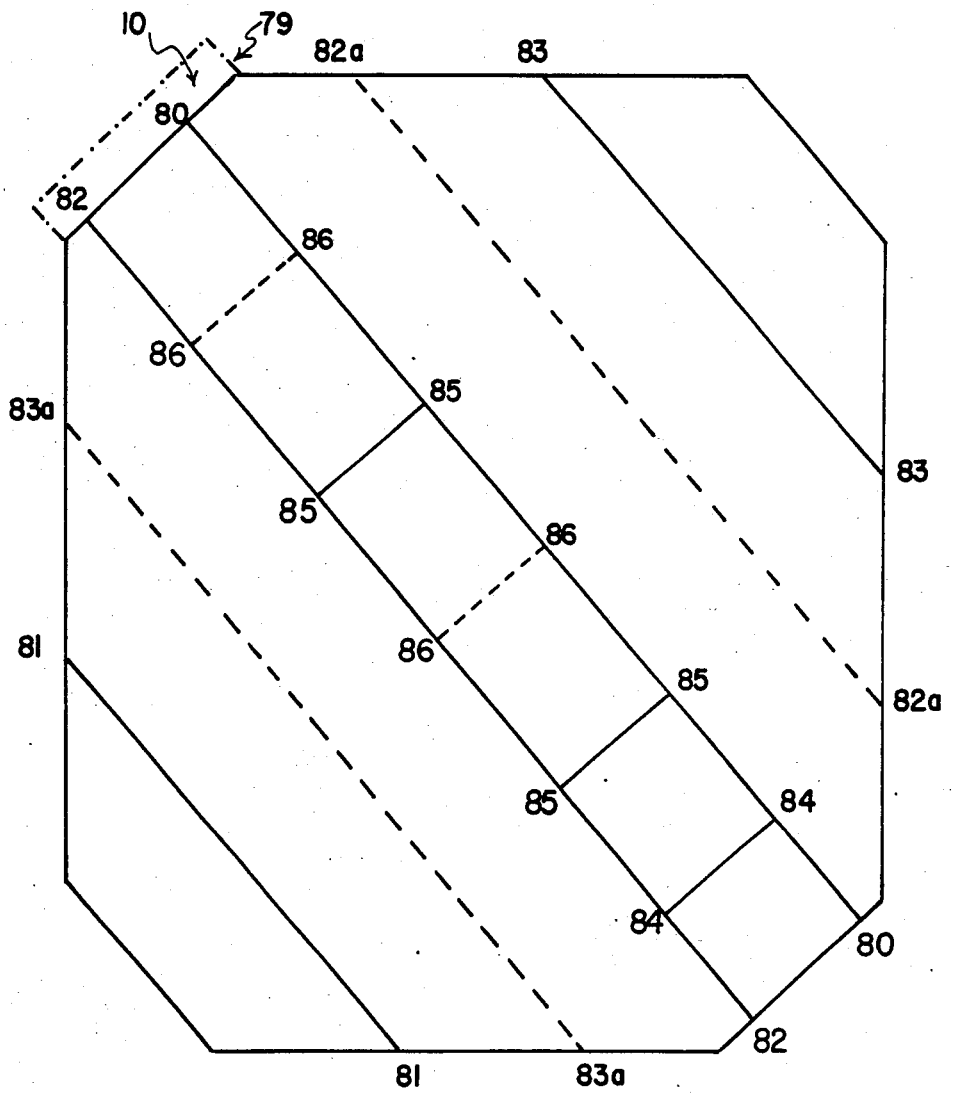
FIG. 6 is a diagram of a breathing bag.

Referring now to FIG. 6, the breathing bag 10 in an empty, relaxed, condition is generally in the shape of a rectangle with its corners removed and consists of two flat sheets welded or otherwise bonded together around the edges, with a mouth member 79 (not shown in detail) that engages with the connector 77 occupying the cut-off portion in the top left-hand corner of the bag 10 as seen in FIG. 6. In order to pack the breathing bag, which when flat may be about 35 cm×30 cm, in as small a space as possible, the top right hand (as seen in FIG. 6) portion is folded upwards along the line 80—80, so that the top right hand cut-off edge comes to lie about half-way down the left hand side, with the edge lying just inside a line 81—81. Then the bottom left-hand portion is folded upwards along the line 82—82 taking with it the folded top right-hand portion, which is folded downwards (as seen in FIG. 6) along a line **82*a*–82*a* that coincides with the line 82—82. The two portions are then folded back, the top right portion being folded upwards along a line 83—83 and the bottom left portion being folded back downwards (as seen in FIG. 6) along a line 83*a*–83*a*. The bottom left-hand portion is then folded along the line 81—81 over the top right-hand cut off edge. The result is a compact strip with the entire long diagonal from top left to bottom right, and the mouth member 79, on the bottom ply and shorter and shorter plies, culminating in the top right-hand and bottom left-hand edge portions, on top. If the bag is then unfolded, it will be found to have creases forming valleys at the locations of the solid lines 80—80, 81—81, 82—82, and 83—83 and ridges at the locations of the dashed lines 82*a*—82*a* and 83*a*—83*a*, with the creases dividing the bag into seven strips of approximately equal widths. The omission of the corners reduces the thickness of the central portion of the strip, which is the thickest part, without appreciably reducing the volume of the bag 10** when expanded.

The bottom end of the strip (that is to say, the end remote from the mouth member 79) is then folded upwards at the line 84—84, and the strip is then folded upwards twice at the lines 85—85 and downwards twice at the lines 86—86 and collapsed concerting-fashion to produce a tight, generally cuboidal wad that can be stored within the bottom end cap 9 of the breathing apparatus, with the portion above the upper fold line 86—86 fanned out and fastened to the connector 77.

The breathing bag 10 is preferably of a laminated material with the inside consisting of a plurality of layers of nylon or polyethylene sheet welded together to give a material that is substantially airtight and the outside consisting of polycotton, that is to say, of a mixture of polyester and cottom fibres. The polycotton is attached to the plastics material by adhesive. To assemble the bag the adhesive may be coated onto a release-paper or similar carrier, the adhesive on the carrier applied to the outer face of the plastics material, the carrier stripped off leaving the adhesive on the plastics material, and the polycotton material applied to the adhesive. The resulting laminate is resistant to tearing and abrasion in use because the plastics material, which must remain airtight, is protected on the outside by the polycotton material.

In order to prepare the apparatus for use, the oxygen cylinder 2 may be charged by removing the screw plug 19 and, with the valve 23 and 25 closed, injecting oxygen under pressure through the orifice 14. The ball 16 then acts as a non-return valve, seating against the seal **15*a*, preventing the oxygen from escaping once the supply of oxygen has been removed until the screw-plug 19 is replaced. Because the ball 16 only acts as the principal valve for a short period, it does not need to provide a totally leak-tight seal and a more elaborate seating for it is unnecessary. Once the oxygen cylinder is charged up, the reducing valve 23 and 24, which also acts as a cylinder-head valve, should preferably be kept shut at all times until the apparatus is required for use although, since the demand valve 5 is a negative-pressure valve, it will in practice provide a second line of defence. As has been indicated above, once the top cap 8 is in place the lever 39 automatically holds the reducing valve 23 and 24** shut.

Because the oxygen cylinder 1 can be recharged without removing it from the apparatus or removing the cylinder-head valve 2 from the cylinder, the cylinder-head pressure-reducing valve 2 and the demand valve 5 always operate together as a pair, so that to some extent each can compensate for variations from nominal performance in the other. In conventional apparatus in which the cylinder and cylinder-head valve are exchanged during routine servicing, that could not be done without re-adjusting the valves every time the cylinder was exchanged.

The charge of carbon dioxide absorbing material 4 in the purifier 3 may be renewed in any convenient way, for example, the top wall of the housing 43 may be removable and the material 4 may be in a pre-filled cartridge.

The polycotton material on the outside of the breathing bag 10 (if it is present) is soaked in an aqueous liquid and the breathing bag is stowed inside the bottom end cap 9, which forms with the bottom end portion of the purifier housing a substantially liquid-tight and vapour-tight seal, at least as regards the liquid with which the polycotton is soaked and the vapour of that liquid. The liquid may be introduced by pouring a measured quantity of liquid into the bottom end-cap 9 immediately before the end-cap is sealed to the purifier housing. The polycotton material will then act as a wick to distribute the liquid all over the breathing bag. The liquid is thus sealed in between the end cap 9 and the impermeable inner lamina of the breathing bag 10.

The purpose of the liquid is to cool the breathing bag 10, and thus the breathing gas inside it, by evaporation when the breathing apparatus is in use. For that purpose water, which has a comparatively high latent heat of evaporation, is suitable, and if desired additives, such as an additive to lower its freezing point and additive to raise or lower its boiling point, a wetting agent, or a bacteriostat, may be included. It is possible to achieve all four of those effects with a single additive, although some reduction in latent heat may result as a side-effect.

If the polycotton material is soaked in liquid, then the adhesive bonding the polycotton to the plastics must be one that will remain effective in spite of being permanently exposed to the liquid while the apparatus is in its normal ready-for-use condition.

The apparatus is worn by the user at the bottom of the diagonal belt 6 of the harness, and thus hangs at about waist level and somewhat to one side, where it is not as likely to be in the wearer's way, and is not as likely to be damaged, as if it were worn permanently on the wearer's chest.

When he needs to use the apparatus, the wearer slides it up the shoulder belt 6 until it is in the centre of his chest, breaks the wire connecting the top an bottom end caps 8 and 9, and removes the end caps. He then exhales, and puts on the nose-clip and mouthpiece, and begins to breathe using the apparatus.

The removal of the top end cap 8 releases the lever 39, freeing the cylinder-head reducing-valve 23 and 24. The wearer does not have to manipulate a manual cylinder-head valve. As may be seen from FIG. 2, the forces acting on the moving assembly within the valve (neglecting friction) are: the oxygen-cylinder pressure, acting on the area of the port 22 and becoming less effective as the valve opens; the pressure in the closed end of the cylinder 21, acting on the area of the piston head 31; and the force of the stack of washers 40.

When the bottom end-cap 9 is removed, the breathing bag 10 falls and unfolds, at least partly, under its own weight. When the wearer first exhales into the breathing bag, the gas pressure further unfolds and expands the breathing bag, which then hangs freely from the connector 77.

Because the area of the port 22 is much smaller than that of the piston head 31, the reducing valve will supply oxygen at a pressure determined primarily by the stack of washers 40, which can be set with some accuracy. The reducing valve might be set to supply oxygen at, for example, 750k Pa with a full oxygen cylinder, the pressure falling by, for example, 10% as the cylinder empties. The travel of the piston 30 and the valve member 24 is limited by the piston head's coming into contact with the high-pressure post 11 while the stack of washers 40 is still under compression.

The volume to the right of the piston head 31 as seen in FIG. 2 is sealed from the exterior to protect the piston head 0-ring 32 and the washers 40 against the water, mud, and the like to which a self-rescue apparatus may be exposed in operation. Because of slight leakages around the valve pad 25 and the 0-ring 32, that volume will in practice usually contain oxygen at slightly above ambient pressure, any significant excess pressure being relieved by the relief valve 41.

When the wearer of the apparatus exhales, his exhaled breath will pass from the mouthpiece, through the flexible hose, into the upper part of the housing 43. The breath will then pass outwards through the outer perforated tube 45B and down through the space outside the outer perforated tube, which space acts as a plenum. The pressure of the exhalation holds the outer flap valve 50B shut and the inner flap valve 50A open, so that the exhaled breath must then pass through the absorbent material 4 to the space inside the inner perforated tube 45A and can only then pass downwards round the demand valve capsule 53, and into the breathing bag 10.

Because the operating characteristics of the reducing-valve 2 are determined largely by the dimensions of the valve mechanism and by the stack of washers 40, which can be made to very precise tolerances, the reducing valve can be made with sufficiently uniform and reliable performance that it needs no further adjustment in the field.

When the wearer inhales, the gas will flow from the breathing bag 10 round the demand valve 5 and up through the purifier 3. If the wearer inhales as deeply as he exhaled, and if the purifying material 4 has absorbed any appreciable amount of carbon dioxide, then the breathing bag may be emptied before the wearer has finished inhaling and the pressure within the apparatus will start to fall. The diaphragm 60 in the demand valve 5 is exposed on its upper side to the pressure within the apparatus, through the large opening 58 and on its underside to ambient pressure through the pipe 57. If the pressure within the apparatus falls far enough below ambient pressure, therefore, the ambient pressure will lift the diaphragm 60, which will turn the lever 73 and urge the free end of the blade 63 downwards. If the movement is sufficient, the demand valve member 67 will be lowered off its seat 56, permitting oxygen from the oxygen pipe 42, that is to say, from the cylinder-head reducing-valve 2, to enter the capsule 53 and thence the housing 43 and the lungs of the wearer until the volume of breathing gas in the apparatus is made up.

It will be seen that there is no oxygen bleed by-passing the demand valve 56 and 67. Oxygen is supplied only on demand, at negative gauge pressure (with respect to ambient pressure at the demand valve), and the apparatus relies on the integrity of its seals to prevent the ambient atmosphere (which may be, for example, muddy water) from entering the apparatus. That has, however, the advantage that no oxygen is wasted and thus the endurance of the apparatus is increased.

When the wearer inhales, the outer valve flap 50B lifts, permitting gas from the breathing bag capsule 10 and the demand valve 5 to pass and straight up the plenum outside the outer perforated tube 45B, without having to pass through the absorbent material 4, and the inner flap valve 50A closes. That arrangement not only reduces the inhalation resistance of the apparatus compared with some previously proposed arrangements, in which the breathing gas mixture flows through the absorbent material in both directions, but also means that the air inhaled is cooler, because the reaction by which carbon dioxide is absorbed is strongly exothermic, so that the absorbent material 4 is always hot when the breathing apparatus is in operation, and if the gas being inhaled passes through the hot absorbent material it is inevitably heated up and has no opportunity to cool down again before reaching the user. By allowing the gas to pass up the outer plenum, which is the coolest part of the purifier 3, the heating effect is considerably reduced.

Figure 7:
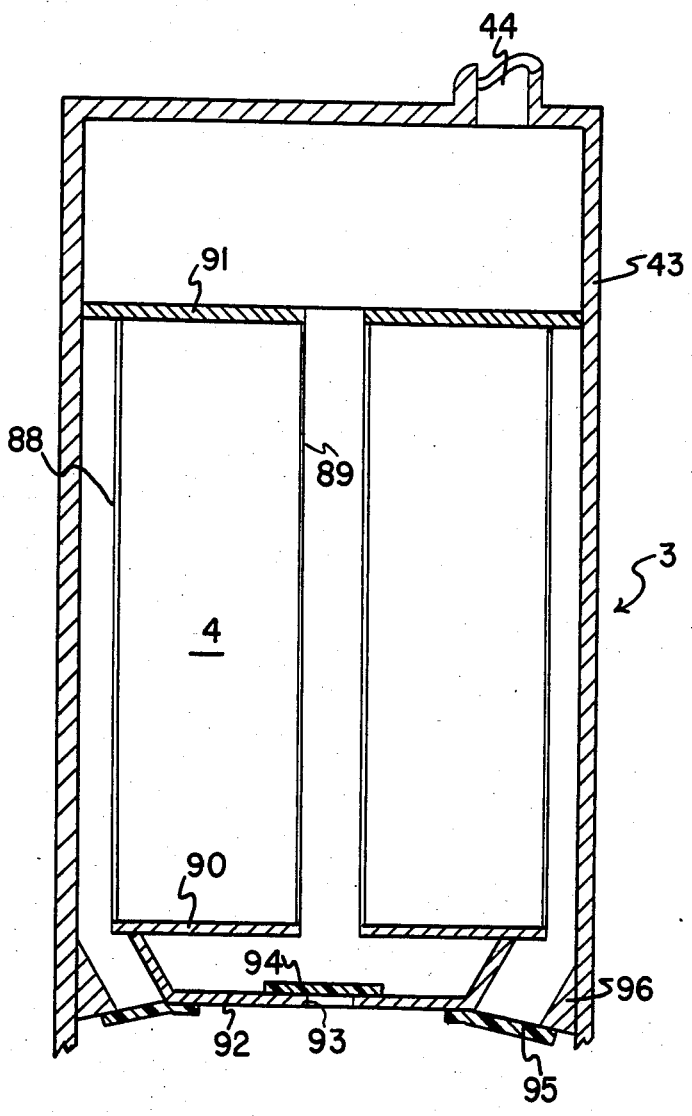
FIG. 7 is a cross-sectional view of an alternative form of purifier, similar to part of FIG. 3.

Referring now to FIG. 7 an alternative form of purifier 3 also has a mass of absorbent material between outer and inner perforated tubes 88 and 89. A bottom end plate 90 closes off only the region between the two perforated tubes 88 and 899, while a top end plate 91 closes both the region between the perforated tubes 88 and 89 and the plenum outside the outer perforated tube 88. A valve box 92 encloses the bottom end of the inner perforated tube 89 and has an opening 93 covered by a valve flap 94 on its inside. An annular valve flap 95 closes off the lower end of the outer plenum and rests against the underside of a seating 96. A single valve-disc similar to that shown in FIG. 4 may be used, with its annular portion 50D clamped between the bottom and side walls of the valve box 92.

With the form of purifier 3 shown in FIG. 7, when the wearer exhales the gas flows outwards through the purifying material 4, and when the wearer inhales the gas flows up through the inner perforated tube 89. The function of the purifier is otherwise the same as that of the form of purifier shown in FIGS. 3 and 4, and the form of purifier shown in FIG. 7 may be used in a breathing apparatus that in all other respects is the same as that shown in FIGS. 1 to 6.

Figure 8:
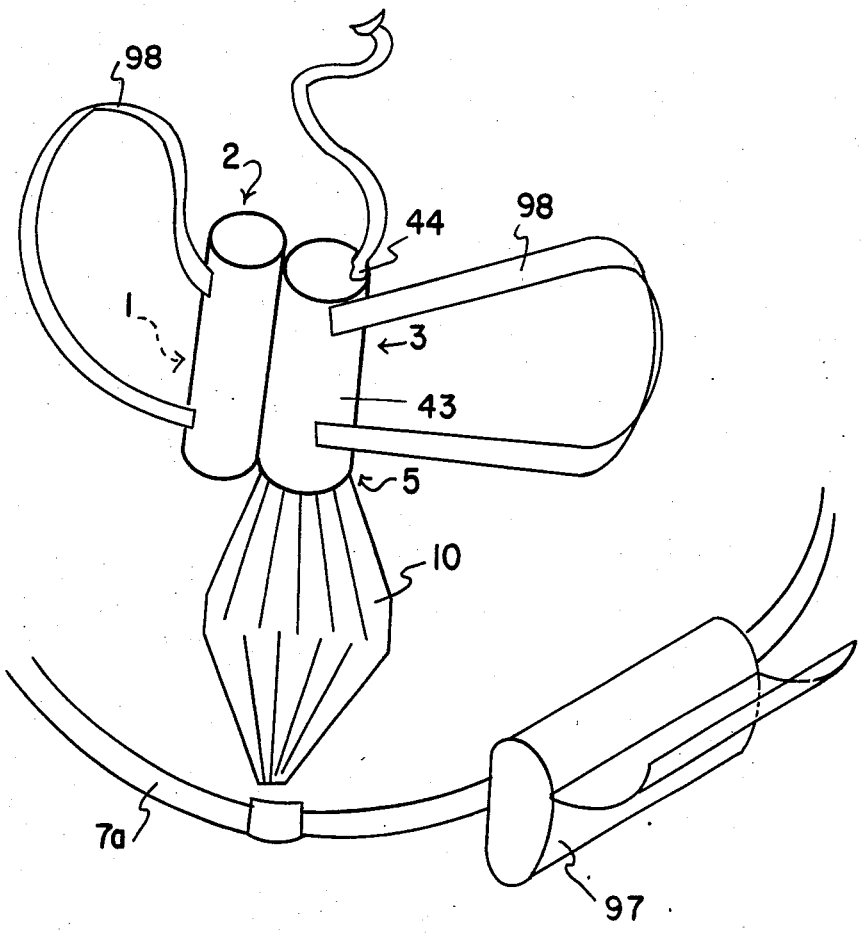
FIG. 8 is a schematic view of an alternative form of breathing apparatus in an operative condition.

Referring now to FIG. 8, instead of being mounted on a diagonal belt as shown in FIG. 1, the breathing apparatus may be carried in a pouch 97 on a waist belt 7*a*. When the apparatus is to be brought into operation, the wearer takes it out of the pouch, passes his arms through two loops 98 of elasticated webbing, and settles the apparatus on his chest with each of the loops passing over one shoulder and under the arm. The elastic provides sufficient accommodation that a single size of loop will fit all normal wearers so that adjustment of the loops when putting the apparatus on in an emergency is unnecessary. In order to reduce the risk of the wearer's losing the breathing apparatus while putting it on, the apparatus may be permanently attached to the waistbelt by a strap that when the apparatus is in use extends downwards from the body of the apparatus to the front of the belt. The breathing apparatus shown in FIG. 8 may in all other respects be the same as that shown in FIGS. 1 to 6, or as shown in FIGS. 1 to 6 modified as shown in FIG. 7.

Figure 9:
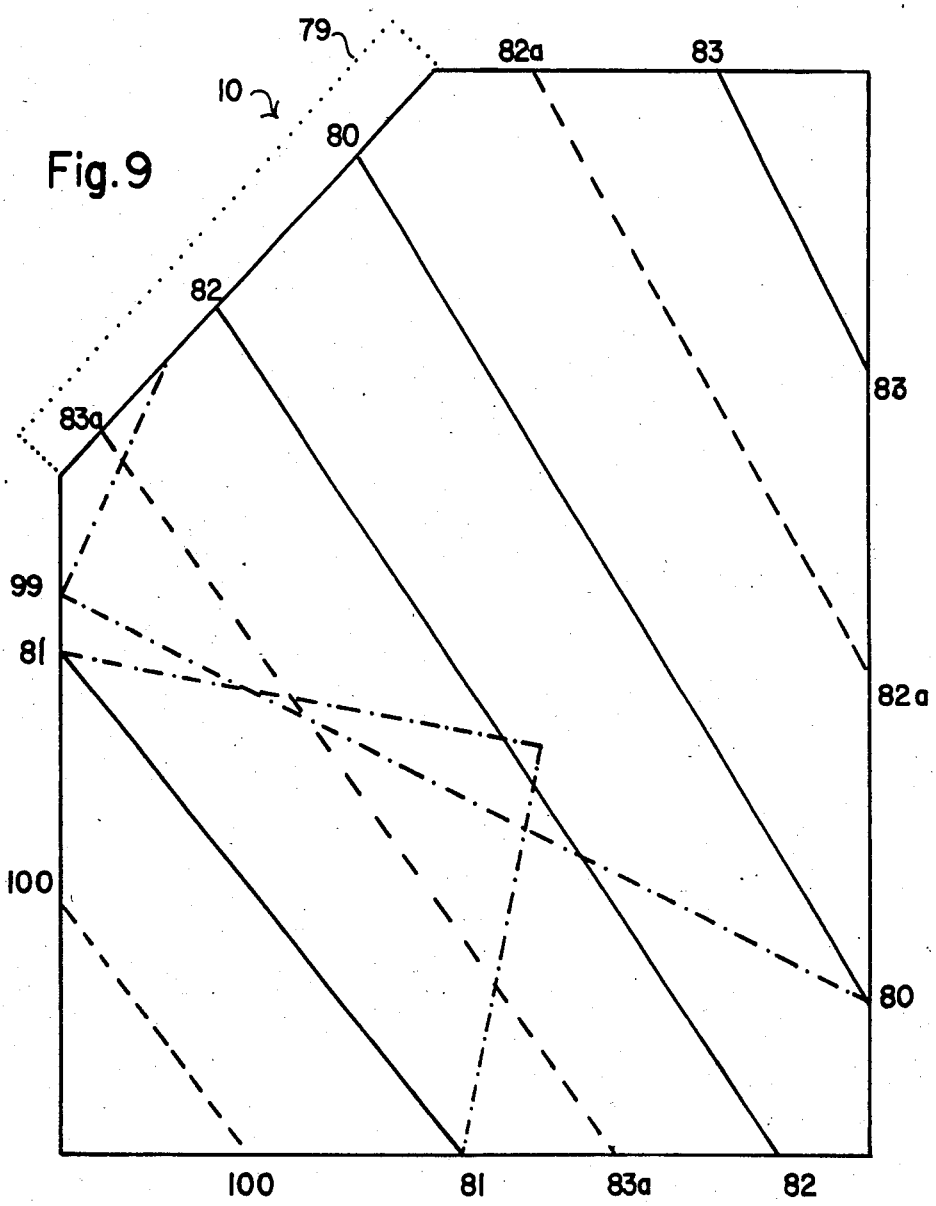
FIG. 9 is a diagram of an alternative form of a breathing bag.

Referring now to FIG. 9, the second form of breathing bag 10 is similar to the first form shown in FIG. 6 except that the corners are not cut off. In order to pack the second form of breathing bag, the top right hand (as seen in FIG. 9) portion is folded upwards along the line 80—80, so that the top right hand corner comes to lie about half-way down the left hand side at the point marked 99, as shown in chain-dotted lines. Then the bottom left-hand portion is folded upwards along the line 81—81 and comes to lie approximately alongside the top right-hand portion, as shown in chain-dotted lines. The two folded portions do not lie quite parallel because in this case the folded lines diverge somewhat towards the top left. The bottom left portion is then folded back at a line 100—100 that corresponds approximately to the cut-off line of the corner in the first form of breathing bag. The left-hand portion of the resulting strip is then folded over to the right along the coincident lines 82—82 and 82*a*—82*a* and back along the coincident lines 83—83 and 83*a*—83*a*. The result is a compact strip with the entire long diagonal from top left to bottom right, and the mouth member 79, on the bottom ply and shorter and shorter plies, culminating in the top right-hand and bottom left-hand corners, on top. If the bag is then unfolded, it will be found to have creases forming valleys at the locations of the solid lines 80—80, 81—81, 82—82 and 83—83 and ridges at the locations of the dashed lines 82*a*—82*a*, 83*a*—83*a*, and 100—100. If, however, the folded strip is rolled up, beginning at the bottom right, it forms a roll that is exceptionally compact for the size of the bag 10, with the mouth member 79 at the outermost point. If the mouth member 79 of the breathing bag 10 is opened out and fastened over the connector 77, it is still possible to fold and roll most of the bag and to store the roll within the connector.

The second form of breathing bag shown in FIG. 9 may be used with any of the forms of breathing apparatus shown in the other drawings instead of that shown in FIG. 6.

What I claim is:

1. Closed-circuit breathing apparatus comprising a breathing bag, and a purifier including housing means; permeable purifying material for removing carbon dioxide from a life-supporting gas mixture located within said housing means; first and second permeable wall means separating said purifying material from respective first and second spaces within said housing means; said housing means defining a first and a second opening, each of the said first and second openings providing communication between the exterior and the interior of said housing means; the first opening providing direct communication between the exterior of said housing means and both said first space and said second space, and the second opening providing direct communication between the exterior of said housing means and said first space while providing communication between the exterior of said housing means and said second space only through said first space, said first permeable wall means, said purifying material and said second permeable wall means in turn; non-return valve means permitting gas to flow between said first space and the exterior of said housing means through the first opening in one direction only so that gas flowing between said first space and the exterior of said housing means in the opposite direction caused to flow through said purifying material; and said purifier having said first opening in communication with said breathing bag and said second opening arranged, when said apparatus is in use, to be in communication with a user.

2. Breathing apparatus as claimed in claim 1, wherein said valve means is so arranged as to cause gas flowing towards said breathing bag to flow through said purifying material and to permit gas flowing from said breathing bag to flow along said first space.

3. A purifier comprising: housing means; permeable purifying material located within said housing means; first and second permeable wall means separating said purifying material from respective first and second spaces within said housing means; said housing means defining a first and a second opening, each of the said first and second openings providing communication between the exterior and the interior of said housing means; the first opening providing direct communication between the exterior of said housing means and both said first space and said second space, and the second opening providing direct communication between the exterior of said housing means and said first space while providing communication between the exterior of said housing means and said second space only through said first space, said first permeable wall means, said purifying material and said second permeable wall means in turn; and non-return valve means permitting gas to flow between said first space and the exterior of said housing means through the first opening in one direction only so that gas flowing between said first space and the exterior of said housing means in the opposite direction is caused toflow through said purifying material.

4. A purifier as claimed in claim 3, wherein one of said first and second permeable wall means is a tube and the said space separated from said purifying material by said one permeable wall means is the interior of said tube.

5. A purifier as claimed in claim 4, wherein the other of said first and second permeable wall means is a tube and encircles said purifying material.

6. A purifier as claimed in claim 5, wherein said other permeable tube is said first permeable wall means.

7. A purifier as claimed in claim 5, which comprises first and second impermeable end walls within said housing enclosing with said first and second permeable tubes said permeable purifying material and wherein said first and second openings are outside said first and second impermeable end walls, respectively.

8. A purifier as claimed in claim 7, wherein said space in the interior of said one permeable tube commuicates with said first opening through an aperture in said first end wall, said space outside said other permeable tube communicates with said first opening round said first end wall, and one of said first and second spaces communicates with said second opening through an aperture in, or round, respectively, said second end wall.

9. A purifier as claimed in claim 8, wherein said valve means comprises a sheet of resilent material having portions disposed between said first inlet and said first and second spaces, said portions of said sheet constituting the valve flaps of non-return flap valves.

10. A purifier as claimed in claim 9, wherein said sheet of resilient material comprises a center, a plurality of sectorial valve flaps attached to said center, a like plurality of strips radiating from said center and separating said flaps, a peripheral calve flap, and an annular portion adjacent to the inner edge of said peripheral flap and continuous with said radiating strips, and which comprises a support fixed to said sheet at said center and at said annular portion and having apertures registering with said sectorial valve flaps.

11. A purifier as claimed in claim 3, wherein said purifying material removes carbon dioxide fjom a life-supporting gas mixture.

* * * * *